US008192108B1

(12) United States Patent
Causey

(10) Patent No.: US 8,192,108 B1
(45) Date of Patent: Jun. 5, 2012

(54) LINE MARKING APPARATUS

(76) Inventor: Rick G. Causey, Dexter, MO (US)

( * ) Notice: Subject to any disclaimer, the term of this patent is extended or adjusted under 35 U.S.C. 154(b) by 133 days.

(21) Appl. No.: 12/718,479

(22) Filed: Mar. 5, 2010

(51) Int. Cl.
*E01C 23/16* (2006.01)

(52) U.S. Cl. ..... 404/94; 239/156

(58) Field of Classification Search ..... 404/93, 404/94; 239/146, 147, 150, 156, 172; 222/608, 222/609; 118/207, 304, 305; 401/21, 35, 401/48, 193, 208, 218, 220
See application file for complete search history.

(56) References Cited

U.S. PATENT DOCUMENTS 892,962 A * 7/1908 Lancaster et al. ..... 222/169
2,988,763 A * 6/1961 Sweet ..... 401/48
3,112,512 A * 12/1963 Arrault ..... 401/219
3,162,369 A * 12/1964 Mitchell ..... 239/150
3,352,283 A 11/1967 Maus
3,700,144 A 10/1972 Smrt
4,545,531 A 10/1985 Williams
4,624,602 A * 11/1986 Kieffer et al. ..... 404/94
4,893,751 A * 1/1990 Armstrong ..... 239/150
5,148,988 A 9/1992 Smrt
5,302,207 A 4/1994 Jurcisin
5,511,896 A * 4/1996 Marcato ..... 404/72
6,062,443 A 5/2000 Smrt
6,413,012 B1 7/2002 Jones
6,698,774 B2 3/2004 Duncan
6,942,735 B2 * 9/2005 Rich ..... 118/313
7,021,860 B1 * 4/2006 Bolstad ..... 404/94

* cited by examiner

*Primary Examiner* — Robert Pezzuto
*Assistant Examiner* — Matthew D Troutman
(74) *Attorney, Agent, or Firm* — Montgomery Patent & Design, LLC; Robert C. Montgomery; Joseph T. Yaksich

(57) ABSTRACT

An apparatus to aid in the layout of hashed lines, particularly for laying out lines in parking lots near parking islands and handicapped parking spots is herein disclosed, comprising a large push broom on wheels. Two (2) canisters of marking chalk project downward from a main horizontal member and are spaced so as to produce parallel chalk lines or chalk dots within no parking areas in a parking lot. A guide arm is located on a side of the apparatus such that it can trace the last set of dots and produce two (2) more in an offset, but equally-spaced manner.

17 Claims, 8 Drawing Sheets

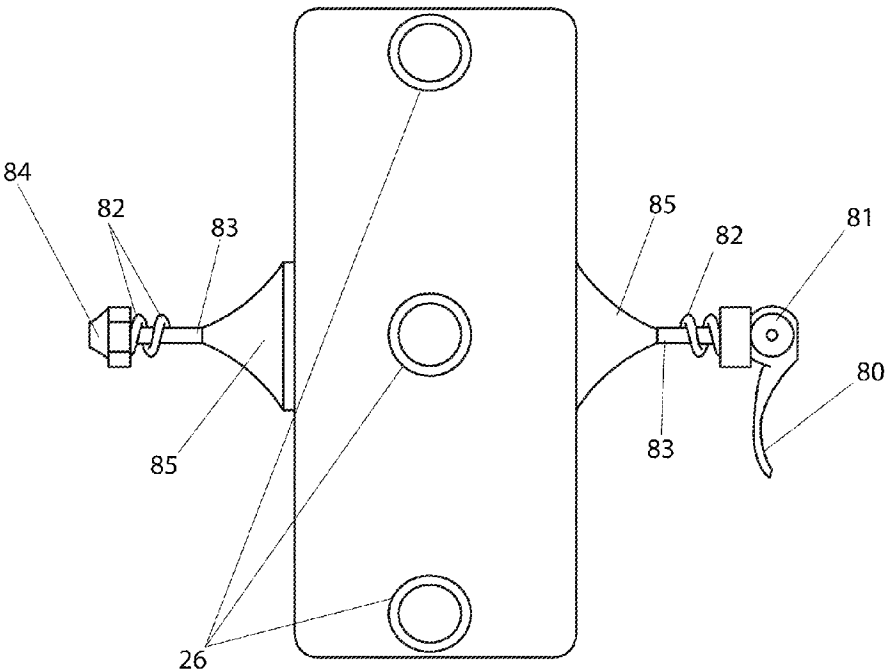
Fig. 6a
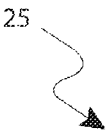

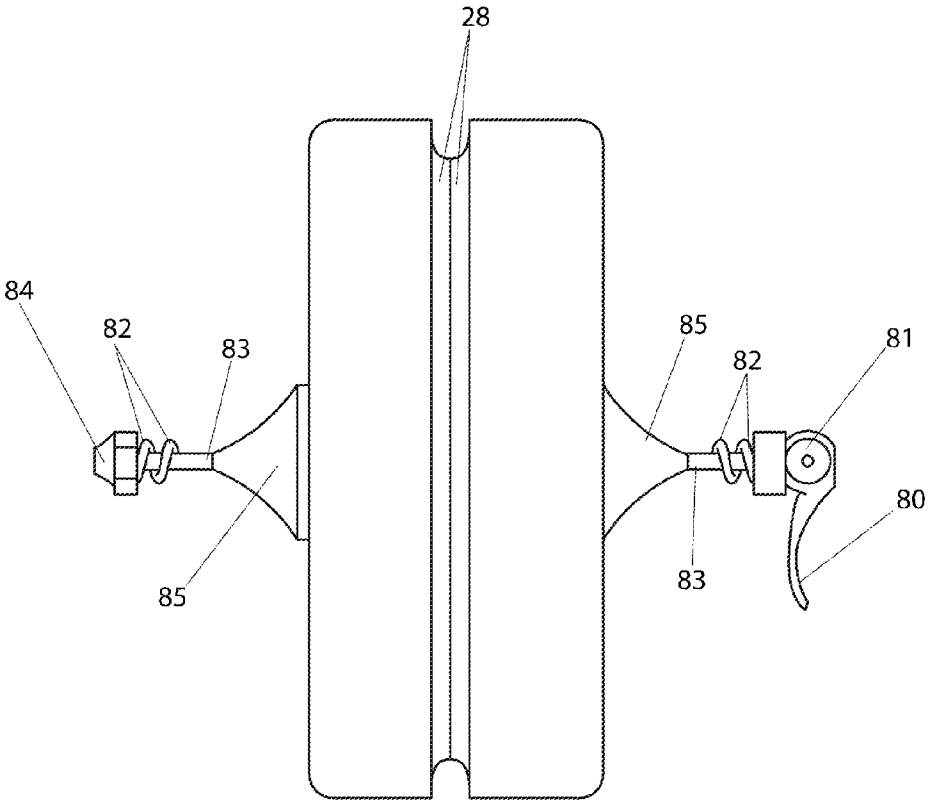
Fig. 6b
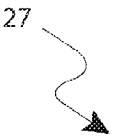

LINE MARKING APPARATUS

RELATED APPLICATIONS

Field of the Invention

The present invention relates generally to apparatuses intended for use in painting chalk lines, and in particular, to an apparatus and guiding mechanism for the simultaneous painting of parallel dotted lines.

BACKGROUND OF THE INVENTION

Paint or chalk markings have been a standard method of delineating various traffic related items and controls for many years. The cheap, simple and durable properties of the method make them a simple and ideal way for presenting vibrant visual cues for drivers of motor vehicles. In particular, parking lots generally contain a high density of such paint markings for the purpose of delineating items and areas such as parking spots, handicapped spots, traffic lanes, directional arrows, no-parking zones, and the like.

One (1) problem associated with such chalk markings is that parking controls require fairly precise patterns and measurements. While some such lines may be adequately serviced by utilizing various paint-dispersing vehicles, many lines in particularly crowded or detailed areas require the lines to be painted by means of hand-driven apparatuses. The process of measuring such controls can be tedious by hand, and the process of maneuvering the apparatuses by hand is often lacking in time efficiency or precision.

Various attempts have been made to provide apparatuses intended to help a user when dispensing spray-type chalk or paint. Examples of these attempts can be seen by reference to several U.S. patents. U.S. Pat. No. 3,352,283, issued in the name of Maus, describes a striping device. The Maus device is a common hand-pushed type spray-paint apparatus which allows a user to wheel the device while providing a constant spreading spray of aerosol type paint.

U.S. Pat. No. 5,302,207, issued in the name of Jurcisin, describes a line striper apparatus with an optical sighting means. The Jurcisin apparatus is disposed with a forward bar guide which aids a user in maintaining a straight line while employing the wheeled spray painting method.

U.S. Pat. No. 6,413,012, issued in the name of Jones, describes a striping apparatus for vehicle travel surfaces. The Jones apparatus is a telescoping boom attachment for striping devices which allows a user to adjust the angle of spray.

While these devices fulfill their respective, particular objectives, each of these references suffer from one (1) or more of the aforementioned disadvantages. Many such apparatuses do not provide for various types of lines such as dotted lines commonly used in the initial marking of parking lot areas. Also, many such apparatuses do not provide accommodations for multiple cans of spray chalk. In addition, many such apparatuses do not provide guiding means suitable for accurately marking offset lines as commonly encountered in the painting of parking lots. Furthermore, many such apparatuses are not provided with simple horizontal and vertical adjusting means to allow a user to adjust spacing and handle height. Accordingly, there exists a need for a hand-driven chalk dispensing apparatus for parking lot marking without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for an apparatus which allows a user to paint items commonly encountered in parking lot marking, such as offset lines and dotted lines, in a manner which is simple, adjustable, accurate and time efficient. Thus, the object of the present invention is to solve the aforementioned disadvantages and provide for this need.

To achieve the above objectives, it is an object of the present invention to comprise a two marking assemblies, a main frame assembly, and a handle assembly. The marking assemblies project downward from the main frame and are spaced to produce parallel chalk lines suited for making parking areas of a parking lot.

Another object of the present invention is to comprise the main frame assembly of a frame body, a pair of rear wheels, a pair of marking wheels, a pair of clamping assemblies, and a scale. The frame body comprises a rectangular body support by the rear wheels and marking wheels. The frame body is fabricated of a strong, durable material such as plastic, coated steel, or the like.

Yet still another object of the present invention is to comprise a front portion of the frame body of a marking assembly, a connection assembly, a clamp assembly, and a scale. The marking assemblies comprise a pair of conventional forks and fork fasteners which provide an attachment means for the marking wheels. The marking assemblies provide the marking means for the apparatus.

Yet still another object of the present invention is to comprise a handle assembly which provides a user-operated driving means. The handle assembly comprises a handle portion, first and second extension pipes, an adjustment pin, an adjustment aperture, a pipe coupling, a brace, fasteners, and a clamping means. The handle assembly extends upward from a top portion of the frame assembly. The handle assembly attaches via the pipe coupling and receives the second extension pipe via an interference fitting locking means.

Yet still another object of the present invention is for the second extension pipe to provide a tubular adjustable vertical extension means from the pipe coupling. The second extension pipe comprises an adjustment pin which mates with a corresponding adjustment aperture located on the first extension pipe. The adjustments are completed with a common height adjustment pin which mates with one of a plurality of equally spaced apertures.

Yet still another object of the present invention is to comprise the handle assembly of a brace which supports the handle assembly on the frame body. The brace encompasses the second extending member with a conventional tube clamping means and pair of fasteners. The brace connects to a top portion of the frame body in an arcuate fashion with a fastener on each side.

Yet still another object of the present invention is to comprise a scale which provides a series of ascending numbers similar to a ruler. The scale is integrally attached to a top portion of the frame body and allows a user to selectively position the marking assembly.

Yet still another object of the present invention is to comprise a swiveling guide arm which provides a reference point for a user while operating the apparatus. The guide arm is a rectangular device located on a top portion of the frame body which is capable of being partially removed from each end to provide a guide on the left or right side of the apparatus. A user can trace the length of a previously marked strip to produce an offset chalk line.

Yet still another object of the present invention is to comprise the marking assembly of a chalk container, a container attachment means, a vertical dispensing pipe, a lining, and a connecting member. The vertical dispensing pipe and connecting member for a "T"-shaped means for attached the chalk container to the connection assembly and frame body.

Yet still another object of the present invention is to comprise the chalk container of a conventional bottle-like container comprising a container attachment means. The container attachment means threadably engages an interior portion of the vertical dispensing pipe in a conventional fashion.

Yet still another object of the present invention is to comprise the vertical dispensing pipe of a lining that extends past the end portion of the pipe to direct the flow of chalk to the marking wheels. The lining is constructed of a common material such as foam, rubber, or the like.

Yet still another object of the present invention is to comprise a pair of clamp assemblies which provide an attachment means for the marking assembly and connection assembly to the frame. Each clamp assembly comprises a connecting member, an insulator, and a rectangular slider plate.

Yet still another object of the present invention is to fasten an end portion of the connecting member to the front portion of the frame assembly via the slider plate and a clamp plate installed inside of a clamp channel on the frame assembly. The slider plate comprises a pair of insulators which tightly secure the connection of the clamp plate to the slider plate. The clamp plates are free to slide in a horizontal position, allowing a user to adjust the marking assembly.

In a first embodiment, the marking wheels comprise a conventional quick release wheel utilized for bicycles, strollers, and the like, comprising a lever, a cam, a pair of springs, a shaft, a wheel fastener, and a hub. The wheels also comprise a plurality of dimples which provide indentations equally radially spaced in an intermediate lateral position, which collect and dispense chalk in an even dot-like pattern.

In a second embodiment, the marking wheels comprise a conventional quick-release wheel utilized for bicycles, strollers, and the like, comprising a lever, a cam, a pair of springs, a shaft, a wheel fastener, and a hub. The wheels also comprise a slot located in an intermediate lateral position, which provides a slit to collect and disperse chalk in a solid line.

Yet still another object of the present invention is to provide a method of utilizing the device that provides a unique means of adjusting the marking assemblies, utilizing the guide mechanism, and quickly and accurately marking offset chalk lines specially intended for use in lining areas in parking lots for subsequent painting.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 7:
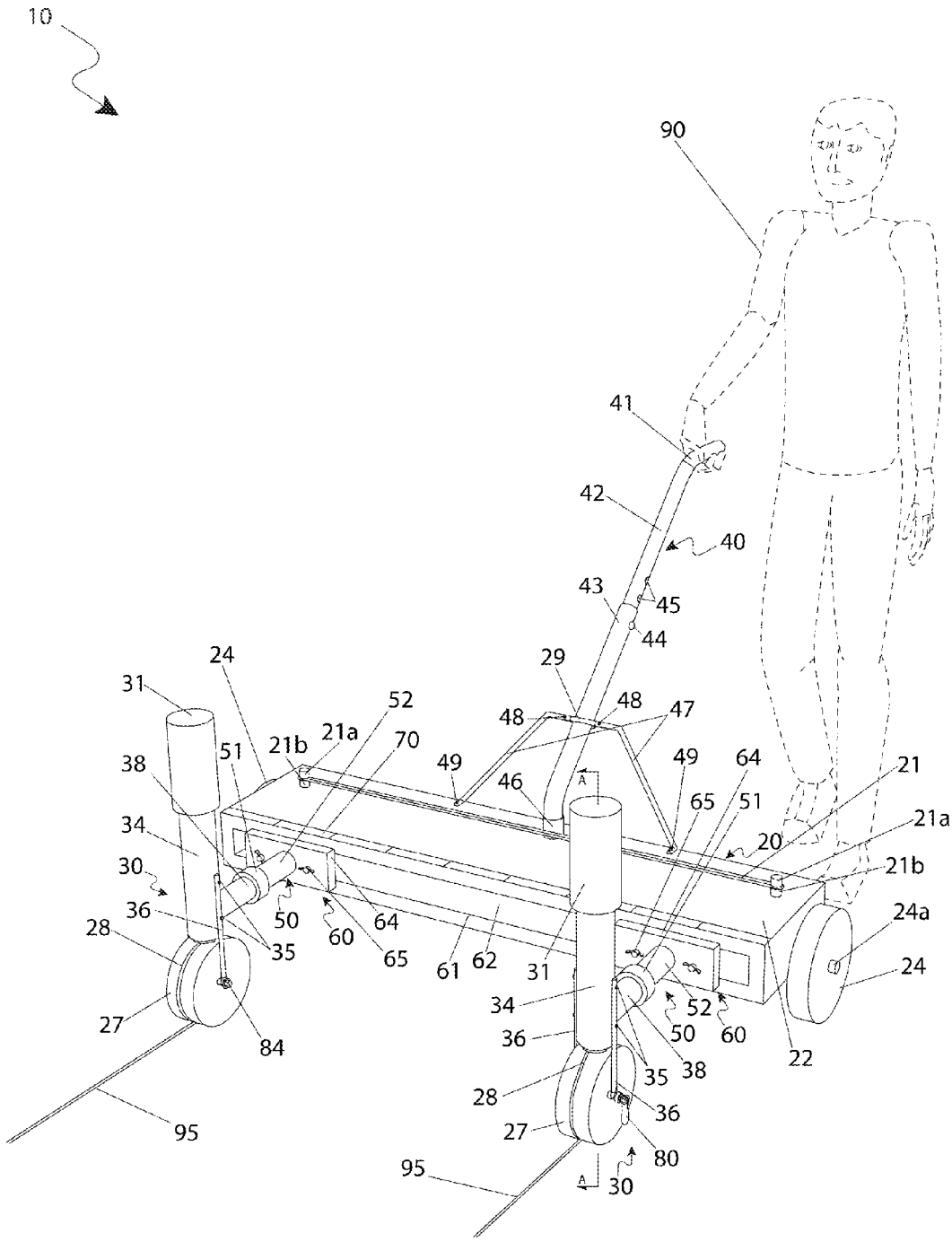

FIG. **6*a* is a front view of a first marking wheel 25 of the line marking apparatus 10**, according to the preferred embodiment of the present invention;

FIG. **6*b* is a front view of a second marking wheel 27 of the line marking apparatus 10, according to the preferred embodiment of the present invention; and, FIG. 7 is a front environmental view of a line marking apparatus 10 depicting the second marking wheel 27**, according to the preferred embodiment of the present invention.

| DESCRIPTIVE KEY | |
|---|---|
| 10 | line marking apparatus |
| 20 | frame assembly |
| 21 | guide arm |
| 21a | guide fastener |
| 21b | fastener securing means |
| 22 | frame body |
| 23 | sleeve |
| 24 | rear wheel |
| 24a | rear axle |
| 25 | first marking wheel |
| 26 | dimple |
| 27 | second marking wheel |
| 28 | slot |
| 29 | clamping means |
| 30 | marking assembly |
| 31 | chalk container |
| 32 | chalk |
| 33 | container attachment means |
| 34 | vertical dispensing pipe |
| 35 | fork fastener |
| 36 | fork |
| 37 | lining |
| 38 | first connecting member |
| 40 | handle assembly |
| 41 | handle portion |
| 42 | first extension pipe |
| 43 | second extension pipe |
| 44 | adjustment pin |
| 45 | adjustment aperture |
| 46 | pipe coupling |
| 47 | brace |
| 48 | first fastener |
| 49 | second fastener |
| 50 | connection assembly |
| 51 | collar |
| 52 | second connecting member |
| 53 | connecting member attachment |
| 60 | clamping assembly |
| 61 | clamp channel |
| 62 | clamp plate |
| 63 | insulator |
| 64 | slider plate |
| 65 | clamp plate fastener |
| 66 | clamp aperture |
| 70 | scale |
| 80 | lever |
| 81 | cam |
| 82 | spring |
| 83 | shaft |
| 84 | wheel fastener |
| 85 | hub |
| 90 | user |
| 95 | chalk line |
| 100 | line strip |

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a line marking apparatus (herein described as the "apparatus") 10, which provides a means for temporarily marking chalk lines 95 on a surface. The apparatus 10 assists a user 90 in the layout of hashed line stripes particularly on parking areas, handicapped parking spots, and the like. The apparatus 10 comprises a portable frame assembly 20 with two (2) marking assemblies 30 projecting downward from said main frame assembly 20, and a handle assembly 40. The marking assemblies 30 are adjustably spaced so as to produce parallel chalk lines 95 particularly suited for making parking areas of a parking lot. A rotatable guide arm 21 is located thereon the frame assembly 20 such that the apparatus 10 can trace a previous chalk line 95 or line strip 100 producing a consistent and equally spaced marking offset. Once an entire area has been marked therewith said apparatus 10, the user 90 follows back over the chalk line 95 with a conventional parking lot painting machine. In such a manner, the work that was typically performed by multiple people can now be done by a single user 90.

Figure 1:
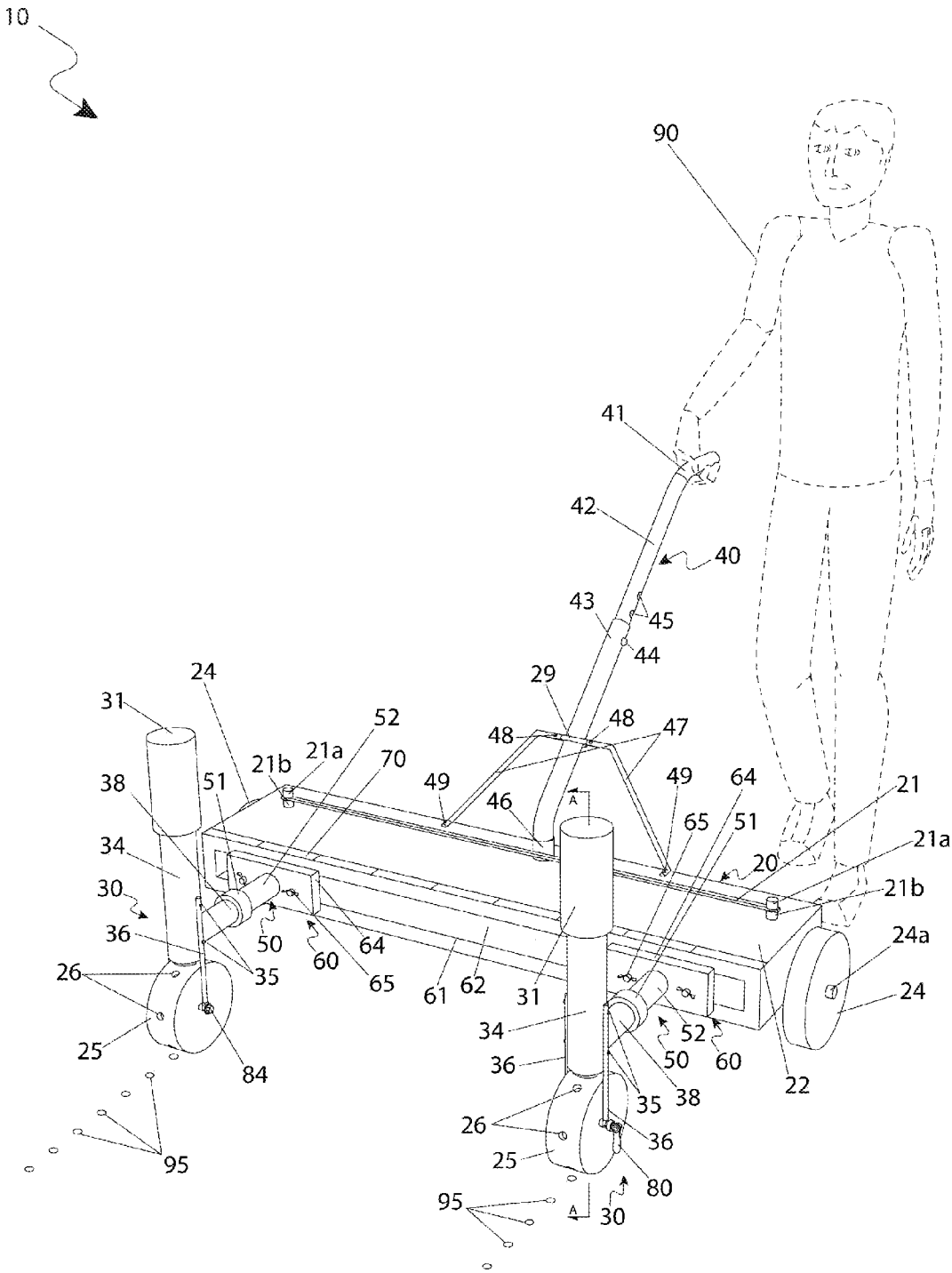
FIG. 1 is a front environmental view of a line marking apparatus 10, according to a preferred embodiment of the present invention.

Referring now to FIG. 1, a front environmental view of the apparatus 10, according to the preferred embodiment of the present invention, is disclosed. The apparatus 10 comprises a frame assembly 20, a pair of marking assemblies 30 (see FIG. 3), and a handle assembly 40 (see FIG. 2). The frame assembly 20 generally comprises a frame body 22, a pair of rear wheels 24, a pair of first marking wheels 25, a pair of second marking wheels 27, a pair of clamping assembles 60, and a scale 70. The frame body provides the apparatus 10 therewith a movable main attachment means for integral components. Said frame body 22 comprises a rectangular body approximately two (2) to four (4) feet in length which is supported by rear wheels 24 and first marking wheels 25 or second marking wheels 27 and fabricated from materials such as, but not limited to: plastic, coated steel, or the like.

A front portion of the frame body 22 comprises a marking assembly 30, a connection assembly 50, a clamp assembly 60, and a scale 70. The marking assembly 30 (also see FIG. 3) provides the marking means for the apparatus 10. Each marking assembly 30 also comprises a pair of conventional forks 36 and fork fasteners 35, thereby providing an attachment means to the pair of first marking wheels 25 or second marking wheels 27. The forks 36 are located on a lower portion of each side portion of the marking assembly 30 and the fork fasteners 35 are conventional fastening means such as, but not limited to screws, pins, latches, or the like. The connection assembly 50 (see FIG. 4) provides an attachment means to the marking assembly to the front portion of the frame body 22.

Figure 2:
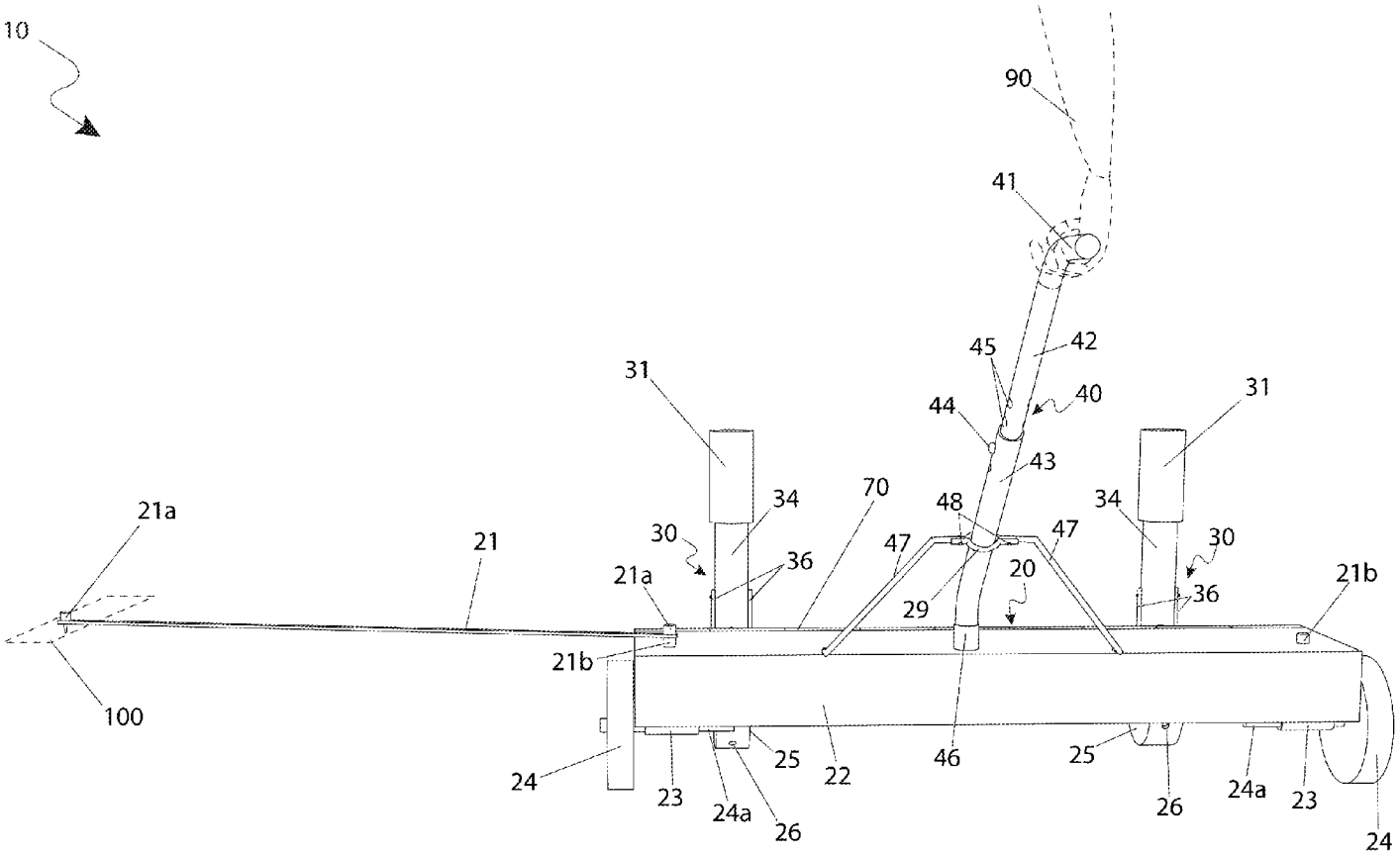
FIG. 2 is a rear environmental view of the line marking apparatus 10, according to the preferred embodiment of the present invention.

Referring now to FIG. 2, a rear environmental view of the apparatus 10, according to the preferred embodiment of the present invention, is disclosed. The apparatus 10 comprises a handle assembly 40, thereby providing a user 90 operated driving means. Said handle assembly 40 comprises a handle portion 41, a first extension pipe 42, a second extension pipe 43, an adjustment pin 44, an adjustment aperture 45, a pipe coupling 46, a brace 47, fasteners 48, 49, and a clamping means 29. Said handle assembly 40 extends upwardly from an intermediate top portion of the frame assembly 20 and attaches to the frame assembly 30 via a pipe coupling 46 which is attached to the frame assembly 30 and receives the second extension pipe 43 via an interference fitting locking means.

The second extension pipe 43 provides a tubular adjustable vertical extension means from the pipe coupling 46. Said second extension pipe 43 comprises a conventional adjustment pin 44 at a top distal location thereto correspondingly mate with an adjustment aperture 45 located on a distal end portion of the tubular adjustable first extension pipe 42. The second extension pipe 43 slidingly engages within the first extension pipe 42, thereby providing varied vertical positions to accommodate a diverse stature of users 90. Said adjustments are preferably completed therewith a common spring-loaded pop-out height adjustment pin 44 mating therewith a corresponding height adjustment aperture 45, of which a plurality are equidistantly spaced there-along the lower portion. The height adjustment pin 44 and height adjustment aperture 45 are similar to those thereon adjustable awnings and tent posts. A top distal portion of the first extension pipe 42 provides the user 90 with a grasping means, thereby directing the apparatus 10 to a desired position. Said first extension pipe 42 comprises an integrally molded arcuate tubular handle portion 41, thereby providing the grasping means for the user 90.

The handle assembly 40 also comprises a brace 47, thereby providing a supporting means for said handle assembly 40 to the frame body 22. The brace 47 encompasses the second extending member 43 at an intermediate position and is secured on two (2) sides with a conventional tube clamping means 29 which is further secured with a pair of first fasteners 48. Said first fasteners 48 are preferably comprised of a conventional screw and nut combination, yet other fastening means may be provided without limiting the functions of the apparatus 10. The brace 47, in an arcuate fashion, connects thereto a top portion of the frame body 22 and is fastened on each side with a second fastener 49. Said second fastener 49 is also preferably comprised of a conventional screw and nut combination, yet other fastening means may be provided without limiting the functions of the apparatus 10.

The apparatus 10 also comprises a scale 70, thereby providing numerical indicia to position the marking assembly 30 to a user 90 desired position. The scale 70 comprises a series of ascending numbers similar thereto a ruler and is integrally attached and located on a top portion of the frame body 22.

The apparatus 10 further comprises a pair of rear wheels 24, thereby providing movement to the rear portion of said apparatus 10. The rear wheels 24 are slightly larger in diameter than the front marking wheels 25, 27 and are positioned thereon the side portions of the frame body 22. Said rear wheels 24 attached to a bottom portion of the frame body 22 thereby inserting a rear axle 24*a* thereinto a tubular sleeve 23 and securing therewith a conventional fastening means. The rear wheels 24 are preferably plastic or rubber, yet other materials may be utilized without limiting the functions of the apparatus 10.

The apparatus 10 yet further comprises a swiveling guide arm 21, thereby providing a reference point for the user 90 to utilize while operating the apparatus 10. Said guide arm 21 travels along the length of a previously marked line strip 100, thereby allowing the user 90 to trace said line strip 100 therewith the guide arm 21 and produce an offset chalk line 95. The guide arm 21 is a rectangular device located there on the top portion of the frame body 22 and is secured to said frame body 22 therewith a guide fastener 21*a* and fastener securing means 21*b*. The guide fastener 21*a* is a conventional digit operated threadably engaged fastener and the fastener securing means 21*b* is a fixed threaded device which accepts the guide fastener 21*a*. The guide arm 21 is capable is of being partially removed from each end, thereby providing a guide thereon the left or right side of the apparatus 10. The guide arm 21 is a durable material similar thereto the frame body 22.

Figure 3:
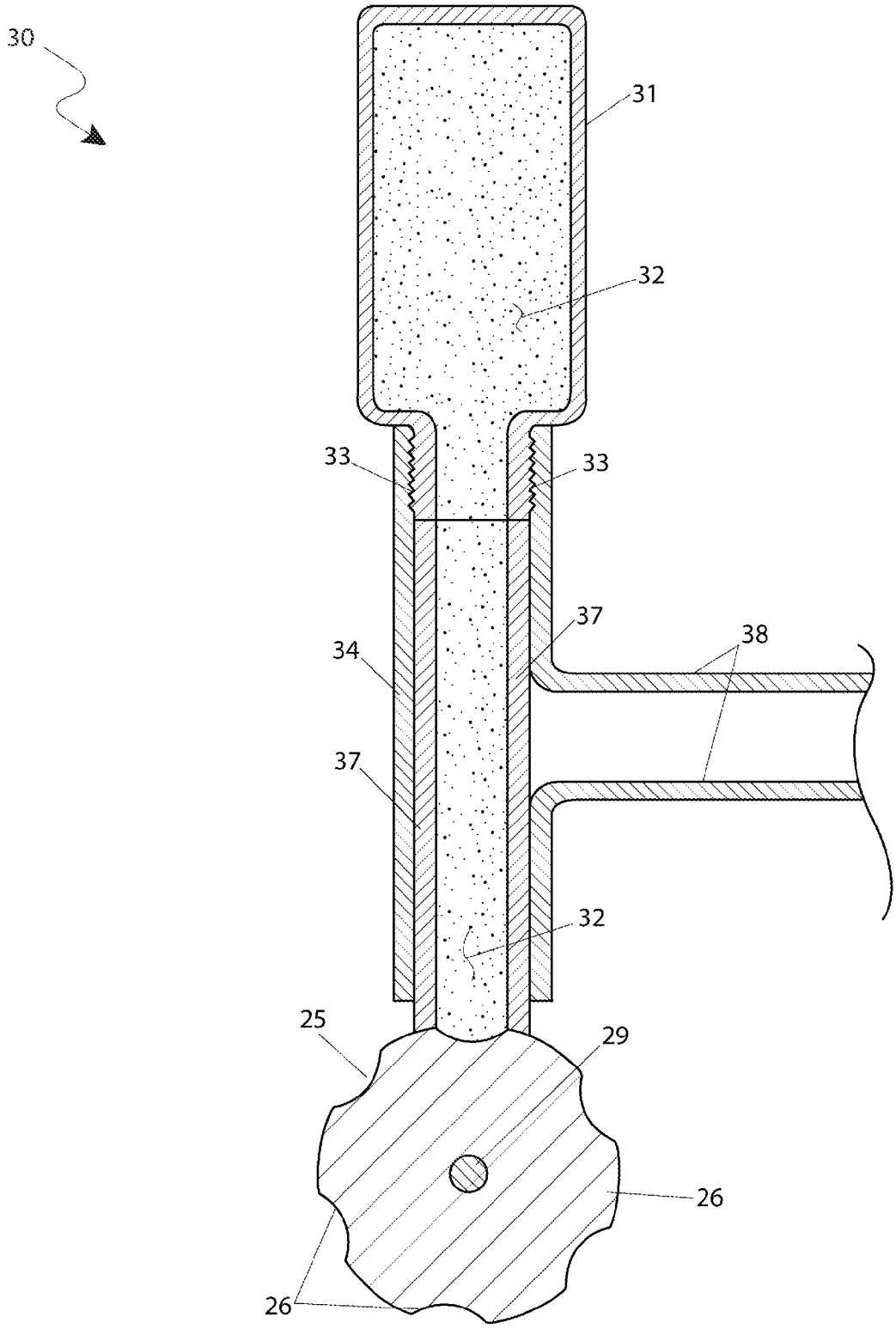
FIG. 3 is a section view of a marking assembly 30 taken along section line A-A of the line marking apparatus 10, according to the preferred embodiment of the present invention.

Referring now to FIG. 3, a section view of a marking assembly 30 taken along section line A-A of the apparatus 10, according to the preferred embodiment of the present invention, is disclosed. The apparatus 10 comprises a marking assembly 30 which further comprises a chalk container 31, a container attachment means 33, a vertical dispensing pipe 34, a lining 37, and a first connecting member 38. The vertical dispensing pipe 34 and first connecting member 38 create a "T"-shaped attachment means to the chalk container 31 and a connection assembly 50, thereby attaching the marking assembly 30 to the frame body 22. The chalk container 31 is a conventional bottle-like container which is filled therewith chalk 32 either by the user 90 or pre-filled by a manufacture. Said chalk container 31 comprises a container attachment means 33, thereby providing a conventional threaded means located at a distal exterior portion on the neck of said chalk container 31. The container attachment means 33 threadably engage an interior portion of the vertical dispensing pipe 34 in a conventional fashion. Said vertical dispensing pipe 34 comprises a lining 37 that extends slightly past the end portion of the vertical dispensing pipe 34, thereby directing the flow of chalk 32 to a dimpled 26 portion of a first marking wheel 25 (see FIG. 6*a*) or a slotted 28 portion of a second marking wheel 27 (see FIG. 6*b*). The lining 37 is preferably a material such as, but not limited to: foam, rubber, or the like. The marking assembly 30 is also preferably fabricated from a similar material as the frame body 22, yet other materials may be incorporated without limiting the functions of the apparatus 10.

Figure 4:
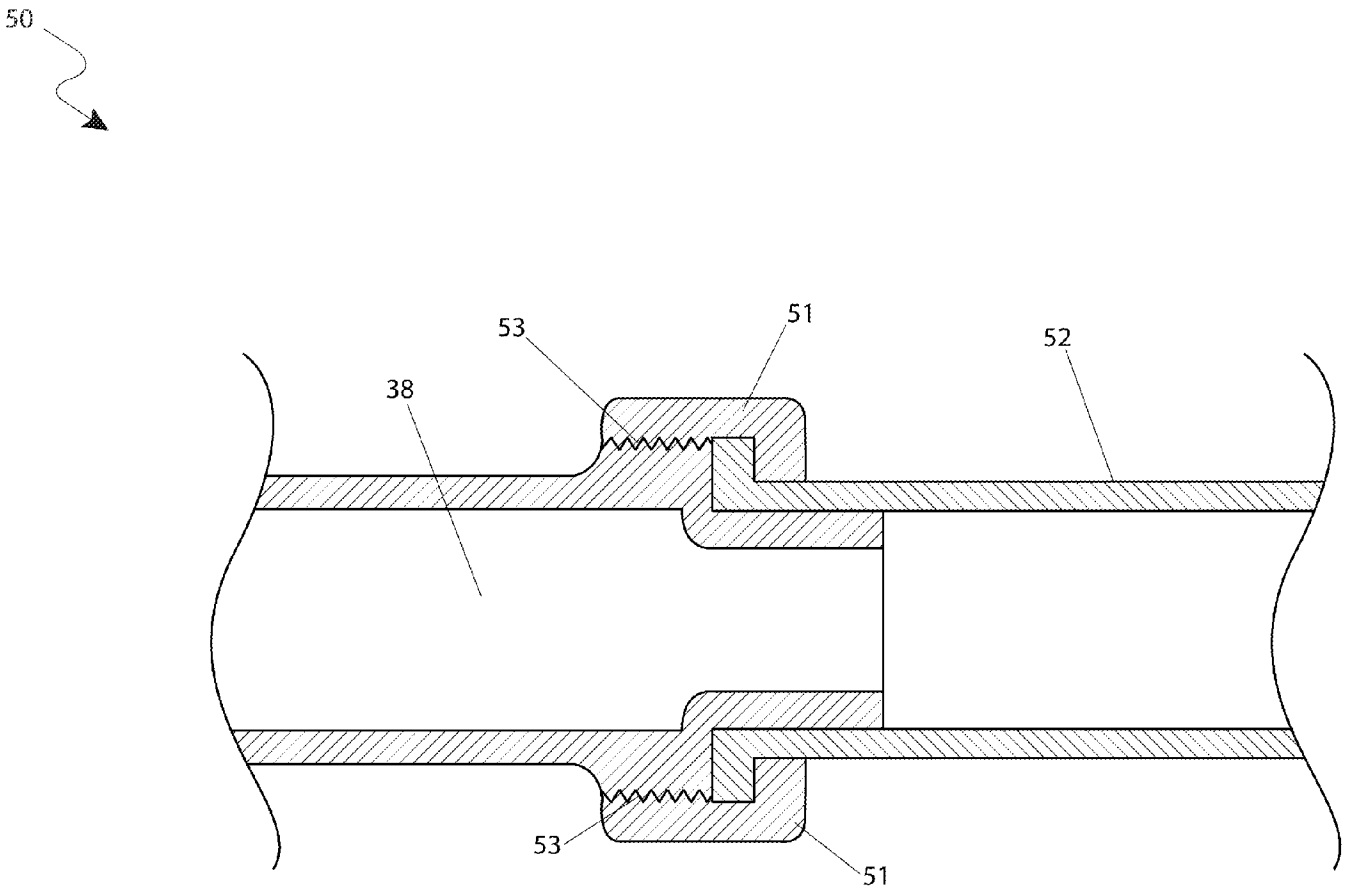
FIG. 4 is a section view of a connection assembly 50 taken along section line A-A of the line marking apparatus 10, according to the preferred embodiment of the present invention.

Referring now to FIG. 4, section view of a connection assembly 50 taken along section line A-A of the apparatus 10, according to the preferred embodiment of the present invention, is disclosed. The connection assembly 50 comprises the first connecting member 38 and a tubular second connecting member 52, thereby providing a mating means for the marking assembly 30 to the frame body 22. The second connecting member 52 also comprises a collar 61, thereby providing a conventional slip union fitting to correspondingly mate the second connecting member 52 to the first connecting member 38. A distal portion of the first connecting member 38 tapers to a smaller diameter, thereby enabling insertion into the second connecting member 52. An exterior portion of said first connecting member 38, superjacent to the distal end, comprises a connecting member attachment 53 which comprises a conventional threaded means to engage a top distal end portion if the second connecting member 52. Once the first connecting member 38 engages the second connecting member 52, the collar is preferably slid along the second connecting member 52 thereto threadably engage the connecting member attachment 53 thereon the first connecting member. The collar 51 is then rotated thereto fasten the connecting members 38, 52 together. The second connecting member 52 and collar 51 are preferably fabricated from an identical material as the frame body 22, yet other materials may be utilized without limiting the functions of the apparatus 10.

Figure 5:
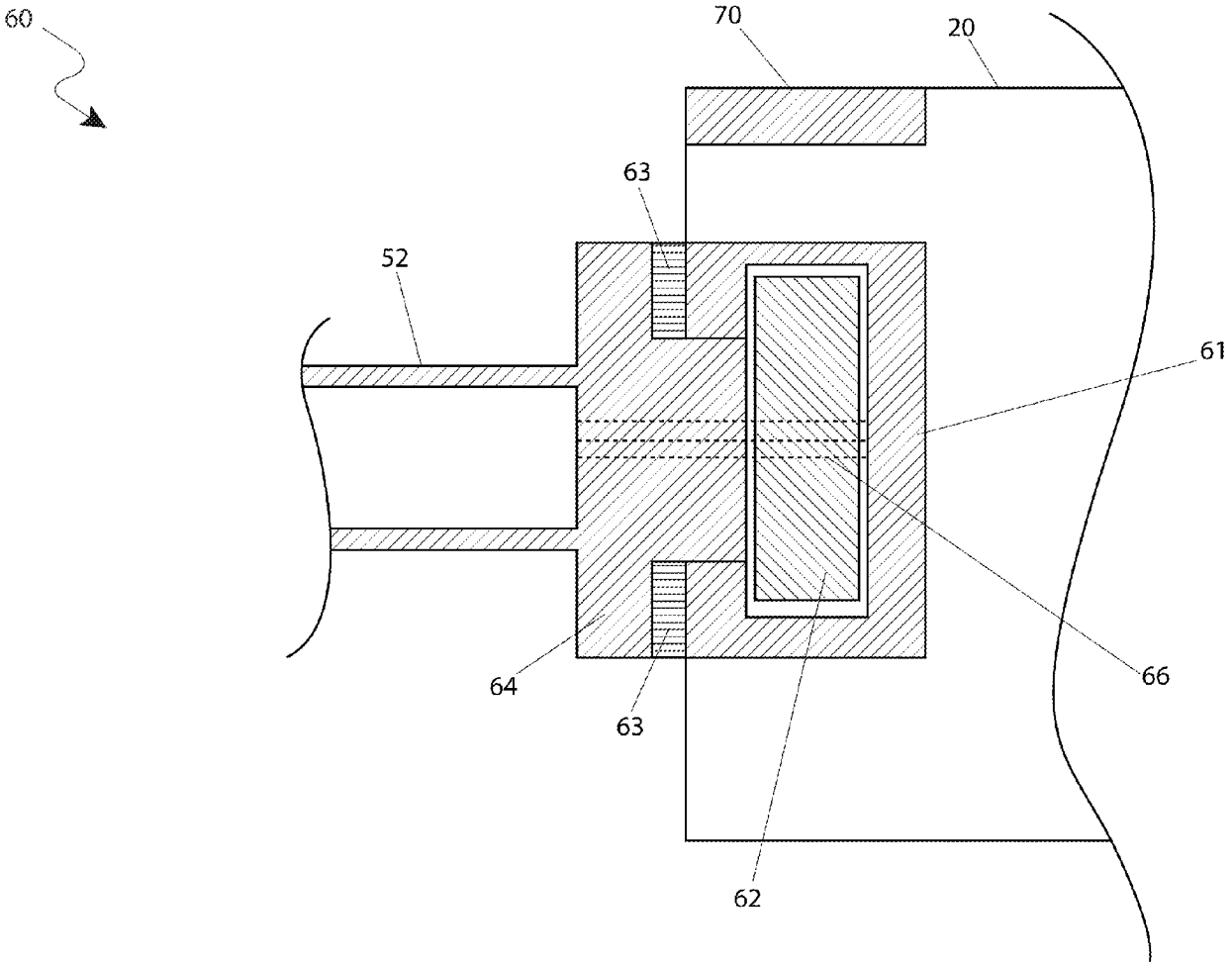
FIG. 5 is a section view of the a clamp assembly 60 taken along section line A-A of the line marking apparatus 10, according to the preferred embodiment of the present invention.

Referring now to FIG. 5, a section view of the clamp assembly 60 taken along section line A-A of the apparatus 10, according to the preferred embodiment of the present invention, is disclosed. The apparatus 10 comprises a pair of clamp assemblies 60, thereby providing an attachment means for the pair of marking assembly 30 and connection assembly 50 to the frame 20. The clamp assembly 60 comprises the second connecting member 52, an insulator 63, and a rectangular slider plate 64. An end portion of the second connecting member 52 is fastened to the front portion of the frame assembly 20. A "T"-shaped slider plate 64 is an integral part of the second connecting member 52 and provides the connection to the frame assembly 20, specifically to a clamp plate 62, thereby providing a sliding means to the marking assembly 30. The slider plate 64 comprises a pair of insulators 63, thereby tightly securing the connection of the clamp plate 62 to the slider plate 64. The insulators 63 are preferably fabricated from a resilient material such as, but not limited to: plastic, rubber, or the like. The clamp plates 62 are installed thereinside of the clamp channel 61 and are free to slide in a horizontal position, thereby providing a user-adjustable means to the marking assembly 30. Each clamp plate 62 comprises a pair of clamp apertures 66 and is located within the clamp channel 61 thereon the front portion of the frame assembly 20. The second connecting member 52 and slider plate 64 are inserted into the clamp channel 61 thereagainst the clamp plate 62, thereby enabling the slider pate 64 and insulators 63 to engage an exterior surface of the clamp channel 61.

A pair of clamp plate fasteners 65 (see FIG. 1) is inserted into the clamp apertures 66 thereto secure the slider plate 64 to the clamp plate 62 at a desired location determined by the user's 90 preference and works in conjunction with the abovementioned scale 70. The clamp plate fasteners 65 are inserted through the clamp plate 62 and friction fit to a rear surface of the clamp channel 61. The clamp plate fasteners 65 are a conventional fastening device such as, but not limited to: screws, latches, or the like. The user 90 utilizes the scale 70 to determine an appropriate position marking assembly 30. The slider plate 64, clamp plate 62, and clamp channel 61 are preferably fabricated from similar materials as the frame body 22.

Referring now to FIG. 6*a*, a front view the first marking wheel 25 of the apparatus 10, according to the preferred embodiment of the present invention, is disclosed. The first marking wheel 25 is a conventional quick release wheel utilized for bicycles, strollers, and the like which comprises a lever 80, a cam 81, a pair of springs 82, a shaft 83, a wheel fastener 84, and a hub 85. Said first marking wheel 25 also comprises a plurality of dimples 26, thereby providing up to six (6) indentations thereto collect and disperse chalk 32 in a dot-like pattern. Said dimples 26 are located at an intermediate lateral position and are equally spaced in a radial direction. The first marking wheel 25 is attached to the marking assembly therewith the abovementioned fork 36. Said first marking wheel 25 is preferably fabricated from a hard plastic, rubber, or the like.

Referring now to FIG. 6*b*, a front view the second marking wheel 27 of the apparatus 10, according to the preferred embodiment of the present invention, is disclosed. The second marking wheel 27, like the first marking wheel 25, is a conventional quick release wheel utilized for bicycles, strollers, and the like which comprises a lever 80, cam 81, a pair of springs 82, a shaft 83, a wheel fastener 84, and a hub 85. Said second marking wheel 27 also comprises a slot 28, thereby providing a slit thereto collect and disperse chalk 32 in a solid line. Said slot 28 is located at an intermediate lateral position in a radial direction. The second marking wheel 27 is attached to the marking assembly therewith the abovementioned fork 36. The second marking wheel 27 is preferably fabricated from a hard plastic, rubber, or the like.

Referring now to FIG. 7, a front environmental view of the apparatus 10 depicting the second marking wheel 27, according to the preferred embodiment of the present invention, is disclosed. The apparatus 10 also comprises a pair of second marking wheels for utilization in lieu of the first marking wheels 25. As depicted herein the second marking wheels 27 are mounted to each marking assembly 30 as abovementioned. Each second marking wheel 27 creates a pair of parallel solid linear chalk line 95, thereby enabling the user to temporarily mark a desired surface with chalk 32.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of installing and utilizing the apparatus 10 may be achieved by performing the following steps: acquiring the apparatus 10; adjusting the handle assembly 40 to a desired length via the adjustment pin 44 and adjustment apertures 45; installing the first marking wheels 25 via fastening the fork fasteners 35 to the pair of forks 36 thereon the marking assemble 60; utilizing the scale 70 to position the marking assembly 30 to a desired distance; fastening the slider plate 64 to the clamp plate 62 therewith clamp plate fasteners 65; engaging the first connecting member 38 to the second connecting member 52 and tightening the collar 51 to secure together; unfastening a guide fastener 21*a* from the fastener securing means 21*b*, thereby positioning the guide arm 21 to a desired guiding position on a line strip 100 as necessary; engaging the chalk containers 31 therewith the vertical dispensing pipe 34, thereby enabling the chalk 32 to dispense into the vertical dispensing pipe 34 and dimples 26 thereon the first marking wheels 25; directing the apparatus 10 to a desired location via the handle portion 41 thereon the handle assembly 40 via rotating the rear wheels 24 and first marking wheels 25; dispensing chalk 32 onto the dimples 26, thereby creating a pair of dot-like chalk lines 95; refilling the chalk containers 31 therewith chalk 32 as necessary; utilizing the apparatus 10 as necessary; storing appropriately when finished; enjoying the ease of arranging parallel hashed marks on parking lots.

The method of installing and utilizing the apparatus 10 therewith the second marking wheels 27 may be achieved by performing the following steps: acquiring the apparatus 10; adjusting the handle assembly 40 to a desired length via the adjustment pin 44 and adjustment apertures 45; installing the second marking wheels 27 via fastening the fork fasteners 35 to the pair of forks 36 thereon the marking assemble 60; utilizing the scale 70 to position the marking assembly 30 to a desired distance; fastening the slider plate 64 to the clamp plate 62 therewith clamp plate fasteners 65; engaging the first connecting member 38 to the second connecting member 52 and tightening the collar 51 to secure together; unfastening a guide fastener 21*a* from the fastener securing means 21*b*, thereby positioning the guide arm 21 to a desired guiding position on a line strip 100 as necessary; engaging the chalk containers 31 therewith the vertical dispensing pipe 34, thereby enabling the chalk 32 to dispense into the vertical dispensing pipe 34 and slot 28 thereon the second marking wheels 27; directing the apparatus 10 to a desired location via the handle portion 41 thereon the handle assembly 40 via rotating the rear wheels 24 and second marking wheels 27; dispensing chalk 32 onto the slots 28, thereby creating a pair of solid chalk lines 95; refilling the chalk containers 31 therewith chalk 32 as necessary; utilizing the apparatus 10 as necessary; storing appropriately when finished; enjoying the ease of arranging parallel hashed marks on parking lots.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A line marking apparatus, comprising:

a portable frame assembly, further comprising:

an elongated frame body;

a clamp channel longitudinally disposed in a front surface of said frame body; and, a pair of rear wheels each secured in a tubular sleeve located at opposing bottom surfaces of said frame body with a rear axle;

a pair of marking assemblies;

a pair of clamping assemblies adjustably attaching each of said pair of marking assemblies to a front side of said portable frame assembly, each further comprising:

a frame connecting member, comprising a first end removably connected to each of said pair of marking assemblies and a second end;

a "T"-shaped slider plate located at said second end of said frame connecting member;

a clamping plate slidably engaging with said clamp channel of said frame body;

a pair of clamping plate fasteners for removably attaching said slider plate to said clamping plate; and, a pair of insulators securing said slider plate to said clamping plate; and, a handle assembly removably attachable to a rear upper surface of said portable frame assembly;

wherein said apparatus provides a marking means onto a ground surface; and, wherein said pair of clamping assemblies are independently horizontally adjustable with respect to said frame body to a desired spacing width.

2. The apparatus of claim 1, further comprising a scale integrally attached and located on a top portion of said frame body;

wherein said scale provides numerical indicia to position said pair of marking assemblies to said desired spacing width.

3. The apparatus of claim 1, further comprising a guide arm secured to a top portion of said frame body with a guide fastening means;

wherein said guide arm is selectively removed at either end and selectively secured at either end; and wherein said guide arm provides a reference point for said apparatus during utilization by traveling along a previously marked line.

4. The apparatus of claim 1, wherein said frame body further comprises a length of approximately two to four feet.

5. The apparatus of claim 1, wherein said pair of marking assemblies each further comprises:

a dispensing pipe, comprising an upper end and a lower end;

a marking assembly connecting member integrally disposed on said dispensing pipe at an intermediate location and extending rearwardly to terminate at a proximal end;

a marking container comprising an amount of a marking material removably attachable to said upper end of said dispensing pipe;

a lining disposed about an interior circumference of said dispensing pipe and extending outwardly from said lower end;

a pair of forks located on diametrically opposed outer surfaces of said dispensing pipe; and, a marking wheel comprising a marking receiver on an outer surface thereof, said marking wheel removably attachable to said pair of forks;

wherein a distal end of said marking assembly connecting member is removably fastened to said frame connecting member;

wherein said marking container is in fluid communication with said dispensing pipe and said marking receiver of said marking wheel;

wherein said marking material is dispensed from said marking container to said marking receiver of said marking wheel; and, wherein said marking receiver deposits an amount of said marking material onto said ground surface to produce said marking means.

6. The apparatus of claim 5, wherein said marking material is chalk.

7. The apparatus of claim 6, wherein said marking wheel is a quick-release wheel wherein said marking receiver is a plurality of dimples located at an intermediate lateral position and equally spaced in a radial direction on said marking wheel.

8. The apparatus of claim 6, wherein said marking wheel is a quick-release wheel wherein said marking receiver is a continuous slot located at an intermediate lateral position in a radial direction.

9. A line marking apparatus, comprising:

a portable frame assembly, further comprising an elongated frame body, a clamp channel longitudinally disposed in a front surface of said frame body, and a pair of rear wheels attached to said frame body each secured in a tubular sleeve located at opposing bottom surfaces of said frame body with a rear axle;

a pair of marking assemblies, each further comprising:

a dispensing pipe, comprising an upper end and a lower end;

a marking assembly connecting member integrally disposed on said dispensing pipe at an intermediate location and extending rearwardly to terminate at a proximal end;

a marking container comprising an amount of a marking material removably attachable to said upper end of said dispensing pipe;

a lining disposed about an interior circumference of said dispensing pipe and extending outwardly from said lower end;

a pair of forks located on diametrically opposed outer surfaces of said dispensing pipe; and, a marking wheel comprising a marking receiver on an outer surface thereof, said marking wheel removably attachable to said pair of forks;

a pair of clamping assemblies independently adjustably attaching each of said pair of marking assemblies to a front side of said portable frame assembly to a desired spacing width, each further comprising:

a frame connecting member, comprising a first end removably connected to said marking assembly connecting member and a second end;

a "T"-shaped slider plate located at said second end of said frame connecting member;

a clamping plate slidably engaging with said clamp channel of said frame body;

a pair of insulators securing said slider plate to said clamping plate; and, a pair of clamping plate fasteners for removably attaching said slider plate to said clamping plate; and, a height-adjustable handle assembly removably attached to a rear upper surface of said frame body;

wherein said apparatus provides a marking means onto a ground surface;

wherein said marking container is in fluid communication with said dispensing pipe and said marking receiver of said marking wheel;

wherein said marking material is dispensed from said marking container to said marking receiver of said marking wheel; and, wherein said marking receiver deposits an amount of chalk said marking material onto said ground surface to produce said marking means.

10. The apparatus of claim 9, wherein said a handle assembly further comprises:

an extendable shaft having a bottom end removably attached to said frame body, comprising a height adjustable means, further comprising a first extension member and a second extension member slidably engaged in said first extension member;

a handle portion integrally disposed at a top end of said extendable shaft; and, a brace, comprising a clamping means removably attached to said extendable shaft;

wherein said brace provides an additional securing means for said extendable shaft to an upper surface of said frame body;

wherein said height adjustable means secures said extendable shaft into a desired height; and, wherein said handle assembly provides a driving means to said apparatus.

11. The apparatus of claim 10, wherein said height adjustable means further comprises:

a spring-loaded pin at a top portion of said second extension member;

a plurality of apertures located at a bottom portion of said first extension member each sized to correspondingly receive said spring-loaded pin.

12. The apparatus of claim 10, wherein said frame body further comprises a length of approximately two to four feet.

13. The apparatus of claim 10, further comprising a scale integrally attached and located on a top portion of said frame body;

wherein said scale provides numerical indicia to position said pair of marking assemblies to said desired spacing width.

14. The apparatus of claim 13, further comprising a guide arm secured to a top portion thereof of said frame body with a guide fastening means;

wherein said guide arm is selectively removed at either end and selectively secured at either end; and wherein said guide arm provides a reference point for said apparatus during utilization by traveling along a previously marked line; and, wherein said guide arm provides an offset marking line thereto said previously marked line.

15. The apparatus of claim 14, wherein said marking material is chalk.

16. The apparatus of claim 15, wherein said marking wheel further comprises is a quick-release wheel wherein said marking receiver is a plurality of dimples located at an intermediate lateral position and equally spaced in a radial direction on said marking wheel.

17. The apparatus of claim 15, wherein said marking wheel further comprises is a quick-release wheel wherein said marking receiver is a continuous slot located at an intermediate lateral position in a radial direction.

* * * * *